US005775019A

United States Patent [19]

Johnson

[11] Patent Number: 5,775,019

[45] Date of Patent: Jul. 7, 1998

[54] SLEEVE LABEL WITH TAB

[75] Inventor: David E. Johnson, Dawsonville, Ga.

[73] Assignee: SleeveCo, Inc., Dawsonville, Ga.

[21] Appl. No.: 787,847

[22] Filed: Jan. 23, 1997

[51] Int. Cl.[6] ..... G09F 3/00

[52] U.S. Cl. ..... 40/665; 40/306

[58] Field of Search ..... 40/299, 306, 310, 40/312, 324, 663, 665; 281/81, 105

[56] References Cited

U.S. PATENT DOCUMENTS

| | | | |
|---|---|---|---|
| 1,226,897 | 5/1917 | Laussedat | 40/310 X |
| 1,397,079 | 11/1921 | Cohen | 40/665 |
| 1,686,354 | 10/1928 | Wallace | 40/310 |
| 4,199,882 | 4/1980 | Clayman | 40/633 |
| 4,353,467 | 10/1982 | Cowgill . | |
| 4,555,025 | 11/1985 | Weinberg et al. . | |
| 4,621,442 | 11/1986 | Mack . | |
| 4,700,528 | 10/1987 | Bernard . | |
| 5,422,152 | 6/1995 | Langeland et al. . | |
| 5,439,721 | 8/1995 | Pedroli et al. . | |
| 5,575,096 | 11/1996 | Allegre | 40/324 X |

FOREIGN PATENT DOCUMENTS

| | | | |
|---|---|---|---|
| 4126212 | 2/1993 | Germany | 40/306 |

*Primary Examiner*—Brian K. Green
*Attorney, Agent, or Firm*—Kenneth S. Watkins, Jr.

[57] ABSTRACT

A sleeve label for containers comprises a multi-function tab separated from the sleeve label by a seam generally parallel to the axis of the sleeve. The sleeve is made of a stretchable plastic with memory. The sleeve is stretched over the container and relaxed, securing the sleeve to the container. The tab may contain indicia. Alternative embodiments of the tab include a bottom seam to form a storage pocket and perforations to allow removal of the tab. A heat slit aperture in the tab forms a convenient carrying handle for the container.

7 Claims, 3 Drawing Sheets

SLEEVE LABEL WITH TAB

BACKGROUND OF THE INVENTION

The present invention relates to printed packaging labels and, more specifically, to printed stretchable sleeve labels used in labeling containers.

Sleeve labels have replaced adhesive labels on many products such as plastic jugs, bottles, drums and propane/butane cylinders. Sleeve labels are made from stretchable plastic films printed and formed into sleeves which can be placed over the container. They differ from "shrink wrap" packaging in that sleeve labels are made from a plastic film stretched and placed over the product or container as a sleeve. When released, the sleeve relaxes toward a memory condition, securing the sleeve to the product without heat or chemical treatment. Sleeve labels can be easily attached and removed from the container without the use of adhesives. Sleeve labels promote recycling of containers since the old labels can be removed quickly without the residue of adhesives. The stretchable plastic used in sleeve labels is recyclable. Printing, fabrication, insertion, and removal are easily automated, resulting in low cost and good product flexibility. The printing methods used in sleeve labels allow high quality printing and graphics.

The increased use of sleeve labels has created a demand for convenience and marketing features which satisfy needs for the market. For example, labels which provide means for additional consumer information, identification features, and carrying, handling features are constantly in demand. Sleeve labels are not currently satisfying these demands.

U.S. Pat. No. 5,422,152 discloses a sleeve label attachment comprising a stiff strip with an adhesive strip. The device improves speed of installing on a propane cylinder. The device does not provide for additional labeling, carrying or handling features. U. S. Pat. No. 4,621,442 discloses a multi-layered label which comprises a folded leaflet for providing additional consumer information. The label, being adhesively fixed to the container is difficult to remove and makes reuse or recycling of the container difficult. U. S. Pat. No. 4,353,467 discloses a paint applicator holder. The device provides a paint brush holder which attaches adhesively to the paint container. The device, again is difficult to remove and would leave adhesive residue on the container, making reuse or recycling difficult.

SUMMARY OF THE INVENTION

Therefore an object of the present invention is to provide a sleeve label with an integral multi-function tab.

A further object of the present invention is to provide a sleeve label with an integral multi-function tab which does not leave adhesive residue when removed and makes the container easily reusable and recyclable.

A further object of the present invention is to provide a sleeve label with an integral multi-function tab which can be used to provide additional product information as compared with earlier sleeve labels.

A further object of the present invention is to provide a sleeve label with an integral multi-function tab easily removed from the rest of the label.

A further object of the present invention is to provide a sleeve label with an integral multi-function tab providing a removable pocket for storage of accessories useful with the product.

The device comprises a sleeve of stretchable plastic film and a multi-function tab of the same material integral with and separated from the sleeve by a heat seal. The heat seal is continuous from the top of the sleeve to the bottom of the sleeve and is generally parallel to the longitudinal axis of the sleeve. The sleeve has an open top and an open bottom and is made of a plastic film having a capability of stretch with memory. In its simplest embodiment, the sleeve label with multi-function tab comprises two plastic film sleeves separated by a longitudinal seal or seam. It may be made by forming a longitudinal heat seal on a plastic film sleeve in a "lay flat" configuration.

The tab may take several forms. In one embodiment, the tab comprises indicia and a perforation adjacent and generally parallel to the heat seal. A label of this embodiment is useful with refillable containers such as propane or butane cooking cylinders. The tab may be printed with indicia such as "FULL" to indicate that the cylinder contains fuel. Upon return by the customer for refilling, the tab may be easily detached form the sleeve label, resulting in a simple, low cost method for indicating the status of the cylinders.

In a second embodiment, the tab may comprise a bottom seal, forming a pocket attached to the sleeve label for inserting additional product information, warranties, advertising materials, or accessories for use with the product. The pocket may be sealed with a top seal. Perforations may be added below the top seal to facilitate opening of the pocket. A side seal may be added adjacent and parallel to the first seal separating the tab form the sleeve, and a perforation made between the seals. Such a perforation facilitates removal of the pocket from the label.

A further embodiment of the multi-function tab creates a carrying handle for the product by heat slitting an opening or aperture in the tab. The two layers of the plastic film are fused by the heat slit at the circumference of the opening.

BRIEF DESCRIPTION OF THE DRAWINGS

These and other features, aspects and advantages of the present invention will become better understood with regard to the following description, appended claims and accompanying drawings where:

DESCRIPTION OF THE PREFERRED EMBODIMENTS

The following is a description of the preferred embodiments of a stretch sleeve label with integral multi-function tab.

Figure 1:
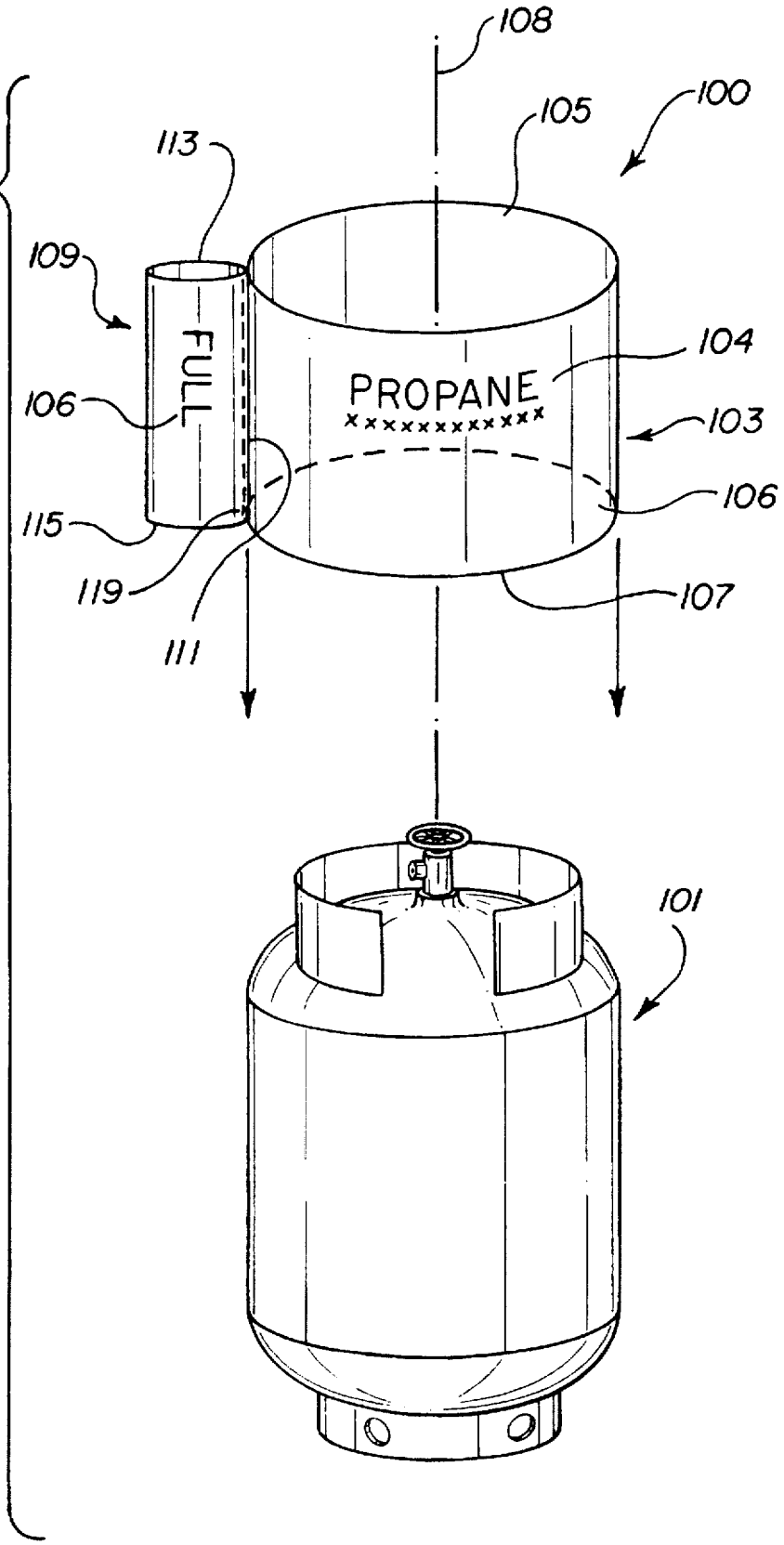
FIG. 1 is a perspective drawing of one embodiment of the sleeve label with multi-function sleeve being applied over a container.

FIG. 1 is a perspective drawing of embodiment 100 of a sleeve label with multi-function tab to be stretched and pulled over a container 101 such as a propane tank. Sleeve label 100 consists of sleeve 103 having an open top 105 and an open bottom 107. Sleeve 103 is closed circumferentially and is made of a plastic film. The plastic film has stretch with memory, i.e., upon stretching an amount sufficient to insert over a container, sleeve 103 returns essentially to its original circumference when relaxed. The circumference of sleeve 103 is typically 0.25%–5% less than the circumference of container 101 when the sleeve is in a relaxed state before assembly. When stretched and inserted over container 101, sleeve 103 is released, causing sleeve 103 to attempt to return to its original circumference. Since container 101 is larger in circumference than sleeve 103 in the relaxed state, sleeve 103 remains stretched, resulting in a constriction force retaining sleeve 103 on the container. The coefficient of friction between the plastic film and the container walls maintains the placement of sleeve label 100 on container 101 once sleeve 103 is relaxed over the container.

Sleeve 103 is normally printed with sleeve indicia 104. Printed surface 106 is normally corona treated to improve printing adhesion. Tab indicia 106 is printed on tab 109, allowing the indicia to be removed along with the tab by perforations 119.

Multi-function tab 109 is attached to sleeve 103 by a seam such as heat seal 111. Seal 1 11 separates tab 109 from sleeve 103 from tab top 113 to tab bottom 115. Seal 111 is generally parallel to longitudinal sleeve axis 108

Figure 2A:
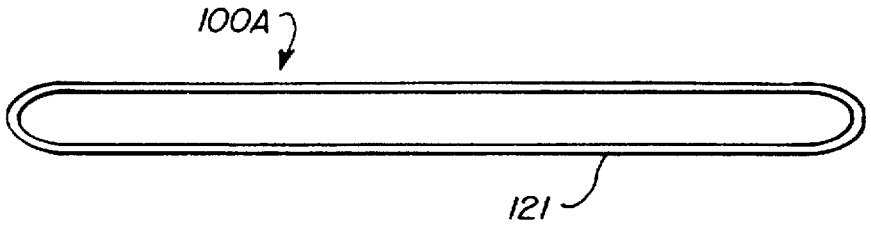
FIG. 2A is a end view of a seamless extruded sleeve label in a lay flat condition before forming the multi-function tab.
Figure 2B:
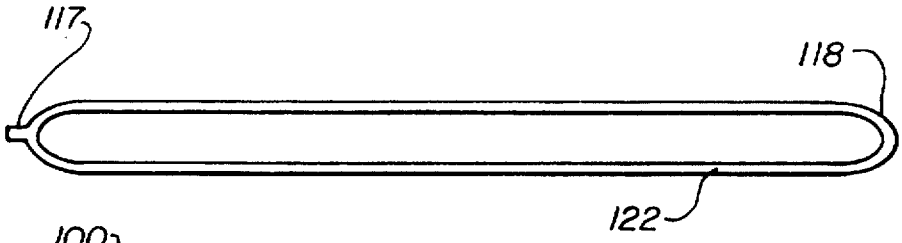
FIG. 2B is a end view of a seamed sleeve label in a lay flat condition before forming the multi-function tab.
Figure 2C:
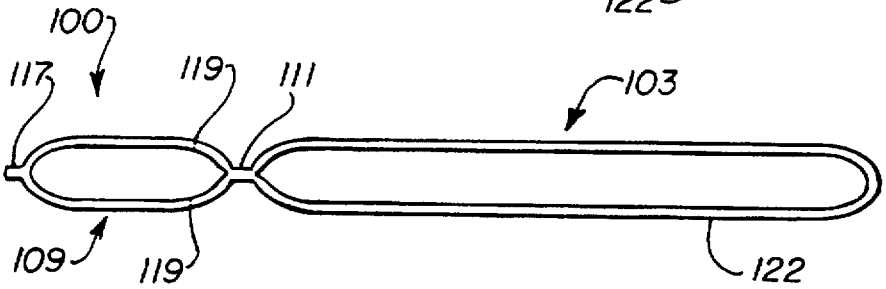
FIG. 2C is a end view of the sleeve label of FIG. 2B in a lay flat condition after the tab heat seal is made, forming a multi-function tab.

FIGS. 2A and 2B are end views showing how a sleeve label with tab is formed. Sleeve 100A comprises a plastic film 121 which is an extruded poly olefin resin. In the preferred embodiment, film 121 is an extruded low density polyethylene (LDPE) film 0.001 to 0.005 inches thick. Sleeve 100A may be formed by the extrusion process to form a seamless tube material 121 as in FIG. 2A or by folding a sheet or roll film 122 at edge 118 of FIG. 2B and heat sealing or heat slitting the web at heat seal 117. Sleeve forming by the heat slitting method is disclosed in application Ser. No. 08/702,282 hereby incorporated as a reference. Tab 109 is formed by tab heat seal 111 of FIG. 2C. Tab heat seal 111 may be made by a heated bar applied to sleeve 100A. Tab heat seal 111 may be formed simultaneously with seal 117 if made from sheet web, or seal 111 may be made subsequent to seal 117. Heat seal 111 separates sleeve 103 from tab 109. In this embodiment, tab 109 is a second sleeve. Optionally, perforations 119 are cut into tab 109 to allow the tab to be easily removed from sleeve 103.

Figure 2D:
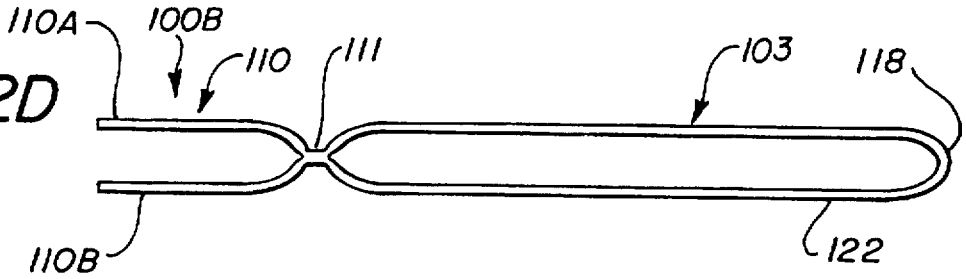
FIG. 2D is a end view of an alternative embodiment of a sleeve label in a lay flat condition where the multi-function tab is made up of two tab flaps.

FIG. 2D shows an alternative embodiment wherein sleeve label 100B is made from roll or sheet film 122. Sleeve 103 and tab 110 are formed by heat seal 111. In this embodiment tab 110 is formed by two tab flaps 110A and 110B. One of the flaps may be removed by cutting. Flaps 110A and 110B are long enough to allow one of the disclosed forms of the multi-function tab to be utilized. Perforations such as 119 of FIG. 2C may be added to one or both of the tab flaps for easy removal.

Plastic film 121 or 122 should have a stretch with memory of at least 0.25% in order for label 100 of FIG. 1 to be installed over container 101 and be retained on the container. In the preferred embodiment, plastic film 121 and 122 have a stretch with memory of at least 5% to allow additional stretching of the sleeve to facilitate installation over the container surfaces.

Figure 3A:
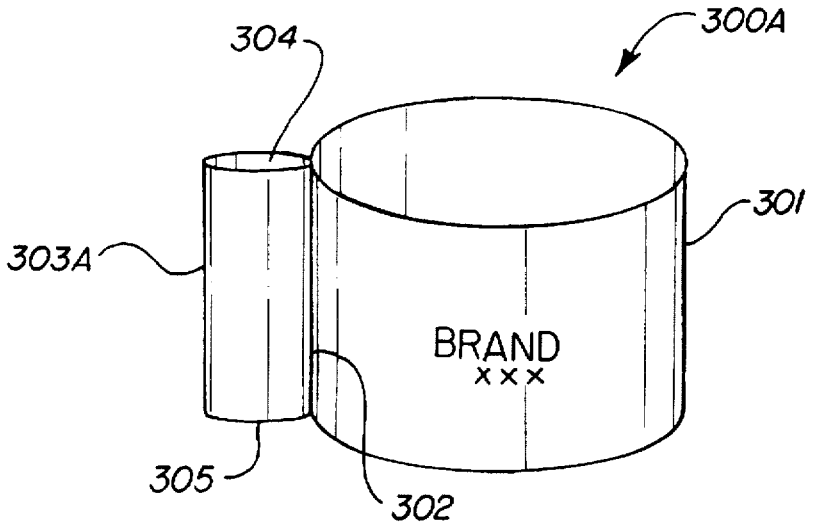
FIG. 3A is a perspective drawing of an alternative embodiment of the sleeve with multi-function tab where the multi-function tab comprises a bottom seam to form a pocket.

FIG. 3A is a perspective drawing of embodiment 300A of a sleeve label with tab comprising sleeve 301, and tab 303A separated by seam 302. Tab 303A comprises a bottom heat seam 305 forming a pocket 304 to retain an object such as a warranty card or instruction sheet (not shown).

Figure 3B:
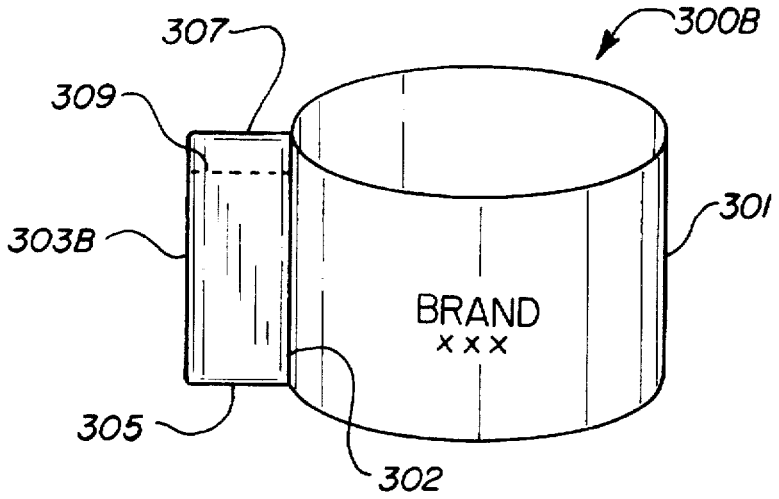
FIG. 3B is a perspective drawing of an alternative embodiment of the sleeve with multi-function tab where the multi-function tab comprises bottom and top seams and a perforation to form a sealed pocket with removable top.

FIG. 3B is a perspective drawing of embodiment 300B of a sleeve label with tab comprising a bottom tab heat seal 305, and a top heat seal 307. This configuration allows printed matter or other objects such as plastic gloves to be fully enclosed and sealed in a pocket. Perforations 309 aid in removing the contents (not shown).

Figure 3C:
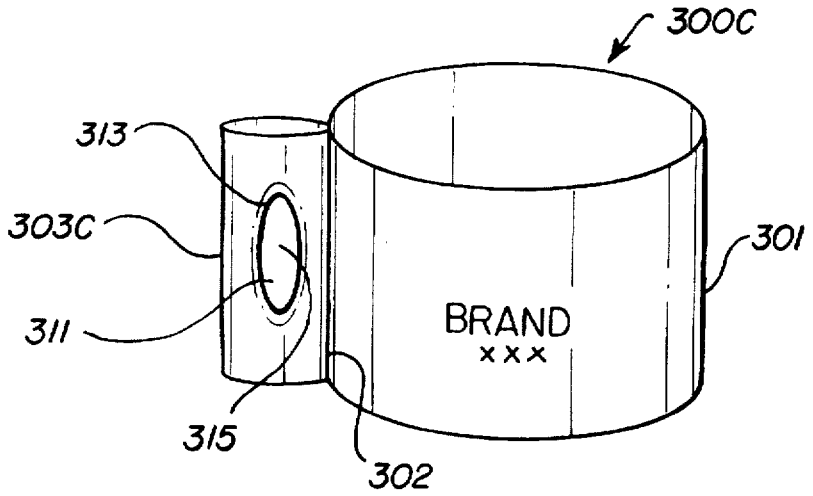
FIG. 3C is a perspective drawing of an alternative embodiment of the sleeve with multi-function tab where the multi-function tab comprises an aperture made by heat slitting, forming a carrying handle for the container.

FIG. 3C is a perspective drawing of embodiment 300C of a sleeve label with tab 303C comprising an aperture 311 in tab 303C. Aperture 311 is formed by heat slitting circumference 313 and removing center portion 315 (shown removed). Aperture 311 forms a convenient carrying handle for a product encased by sleeve 301.

Figure 4:
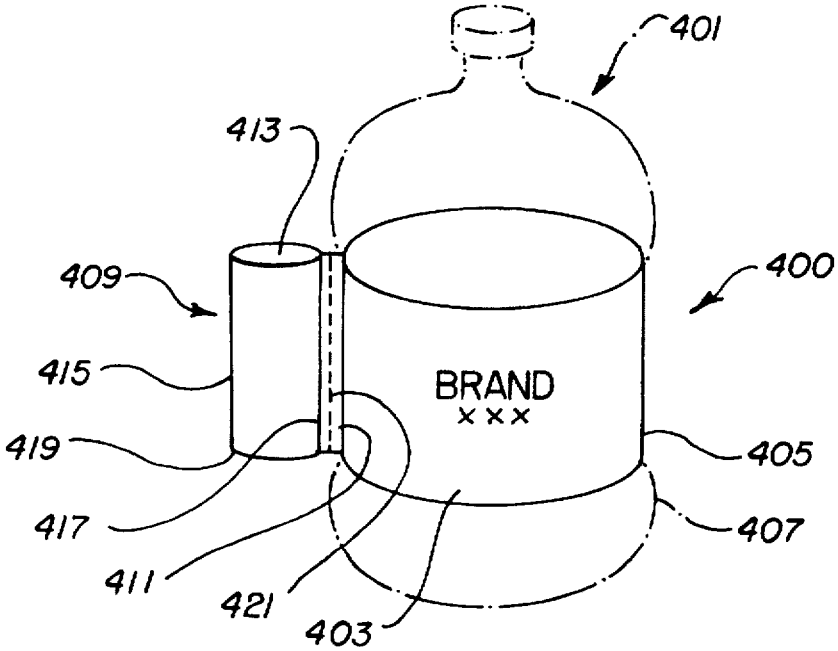
FIG. 4 is a perspective drawing of an alternative embodiment of the sleeve label with multi-function tab where the tab is a removable pocket and the sleeve label is shown installed on a container shown in dotted lines.

FIG. 4 is a perspective drawing of sleeve label with tab 400 installed on a container 401 (shown in broken lines). Sleeve portion 403 is stretched over container 401 and relaxed in recessed portion 405 of container 401. In the installed condition, sleeve portion 403 is stretched beyond its lay flat circumference, typically by 1–3%. Raised portions or ridges 407 of container 401 act as a retaining aid for sleeve portion 403 since additional stretching of sleeve portion 403 is required to displace sleeve portion 403 outside of the recessed portion 405. Tab 409 is separated from sleeve portion 403 by heat seal 411 and provides a removable storage pocket 413. Pocket 413 is formed by outside edge fold 415, side heat seal 417, and bottom heat seal 419. Perforations 421 facilitate removal of the storage pocket from sleeve portion 403.

Accordingly the reader will see that the SLEEVE LABEL WITH TAB provides a sleeve label with a multi-function tab capable of providing additional indicia, storage features and specialty functions. The device provides the following additional advantages:

The label allows a container to be easily reused or recycled;

The label and tab are neat and tidy in appearance; and

The label is simple and low in cost.

Although the description above contains many specifications, these should not be construed as limiting the scope of the invention but as merely providing illustrations of some of the presently preferred embodiments of this invention. For example, the label may be coated or laminated, etc. Thus the scope of the invention should be determined by the appended claims and their legal equivalents, rather than by the examples given.

I claim:

1. A stretchable sleeve label with tab for labeling a product, the sleeve label comprising:

a sleeve made of a stretchable plastic film web with indicia printed on at least one surface of the web, the sleeve comprising an open top and an open bottom, the plastic film web having a predetermined thickness selected from the range of 0.001 inches to 0.005 inches, the web having a stetchability of at least 0.25% with memory whereby the sleeve can be stretched over the product and be retained by a stretch fit over the product;

a tab made of the stretchable plastic film web the tab being smaller in size than the sleeve and the tab is only attached to the sleeve along a single seam by an attachment seal extending in a longitudinal direction from the top of the sleeve to the bottom of the sleeve, the attachment seal being a heat formed seal generally parallel to a sleeve longitudinal axis, the attachment seal disposed between the sleeve and the tab.

2. The sleeve label of claim 1 wherein the tab is a second sleeve comprising a second open top and a second open bottom.

3. The sleeve label of claim 1 wherein the tab comprises indicia printed on a surface of the tab.

4. The sleeve label of claim 1 wherein the tab comprises perforations along a line generally parallel to the sleeve longitudinal axis, the perforations facilitating the removal of the tab.

5. A stretchable sleeve label with tab for labeling a product, the sleeve label comprising:

a sleeve made of a stretchable plastic film web with indicia printed on at least one surface of the web, the sleeve comprising an open top and an open bottom, the plastic film web having a predetermined thickness selected from the range of 0.001 inches to 0.005 inches, the web having a stetchability of at least 0.25% with memory whereby the sleeve can be stretched over the product and be retained by a stretch fit over the product;

a tab made of the stretchable plastic film web, a single side of the tab attached to the sleeve by an attachment seal extending in a longitudinal direction from the top of the sleeve to the bottom of the sleeve, the attachment seal being a heat formed seal generally parallel to a sleeve longitudinal axis, the attachment seal disposed between the sleeve and the tab; and a bottom seal along a lower edge of the tab wherein the tab comprises a pocket formed by the attachment seal and the bottom seal.

6. The sleeve label of claim 5 wherein the tab comprises an auxiliary seal parallel and adjacent to the attachment seal, the auxiliary seal and the bottom seal forming a pocket, and wherein the pocket is separable from the sleeve by perforations disposed between the auxiliary seal and the attachment seal.

7. A stretchable sleeve label with tab for labeling a product, the sleeve label comprising:

a sleeve made of a stretchable plastic film web with indicia printed on at least one surface of the web, the sleeve comprising an open top and an open bottom, the plastic film web having a predetermined thickness selected from the range of 0.001 inches to 0.005 inches, the web having a stetchability of at least 0.25% with memory whereby the sleeve can be stretched over the product and be retained by a stretch fit over the product;

a tab made of the stretchable plastic film web, a single side of the tab attached to the sleeve by an attachment seal extending in a longitudinal direction from the top of the sleeve to the bottom of the sleeve, the attachment seal being a heat formed seal generally parallel to a sleeve longitudinal axis, the attachment seal disposed between the sleeve and the tab; and An aperture in the tab, the aperture comprising a heat seal along a circumference of the aperture, the aperture of a size sufficient to insert a hand whereby the tab serves as a handle.

* * * * *